US006105803A

United States Patent [19]

Standish

[11] Patent Number: 6,105,803

[45] Date of Patent: Aug. 22, 2000

[54] WINE CONSERVING TELESCOPING CONTAINER

[76] Inventor: Miles Standish, 2072 Minoru Dr., Altadena, Calif. 91001

[21] Appl. No.: 09/205,073

[22] Filed: Dec. 3, 1998

[51] Int. Cl.[7] ..... B65D 6/00

[52] U.S. Cl. ..... 220/8; 215/900

[58] Field of Search ..... 220/8, 4.26, 666; 215/900

[56] References Cited

U.S. PATENT DOCUMENTS

| | | | |
|---|---|---|---|
| 169,824 | 11/1875 | McKim | 220/8 X |
| 2,416,142 | 2/1947 | Bennett | 220/8 X |
| 3,819,040 | 6/1974 | Coons | 220/8 X |
| 4,456,134 | 6/1984 | Cooper | 215/900 X |
| 4,865,211 | 9/1989 | Hollingsworth | 220/8 |
| 5,226,551 | 7/1993 | Robbins, III | 220/8 |
| 5,765,708 | 6/1998 | Fragos | 220/8 |
| 5,829,591 | 11/1998 | Lyons | 220/8 X |

*Primary Examiner*—Steven Pollard
*Attorney, Agent, or Firm*—John E. Wagner; Robert C. Smith

[57] ABSTRACT

A rigid wall telescoping wine bottle includes an outer cylinder member having an inner cylindrical wall with internal threads and an inner cylindrical member having a bottom end, a top end and external threads engagable with the internal threads. An axially located tube of small diameter as compared with the diameter of the inner cylindrical wall passes through the top and bottom ends of the inner cylindrical member and terminates at the top end in a transparent threaded neck which serves as a pouring spout. An O-ring seal near the bottom end of the inner cylindrical member seals against the inner wall of the outer cylindrical member. Turning the inner member into the outer member displaces air above the wine minimizing oxidation and causing the wine to be forced up the tube into the neck.

13 Claims, 2 Drawing Sheets

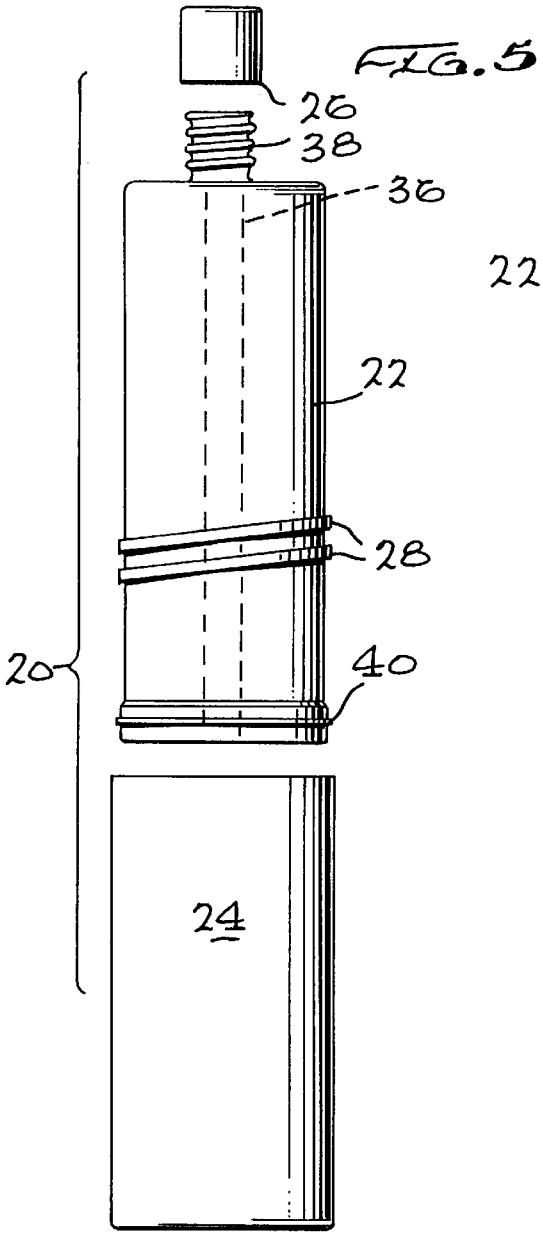
FIG. 5
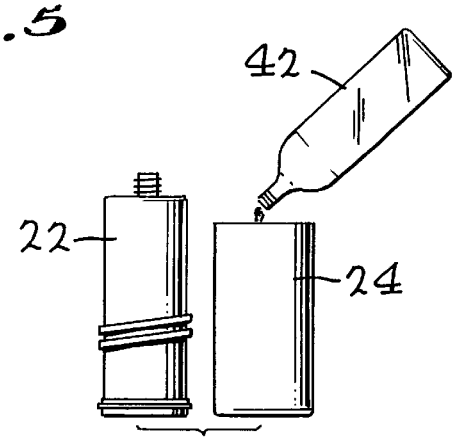
FIG. 6
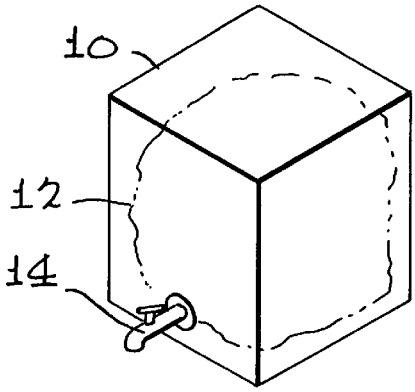
FIG. 1
PRIOR ART
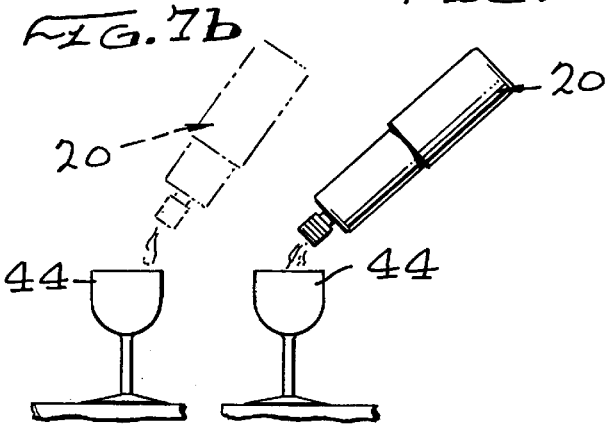
FIG. 7b
FIG. 7a
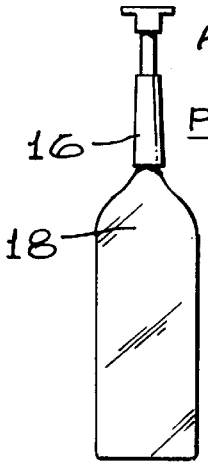
FIG. 2
PRIOR ART

WINE CONSERVING TELESCOPING CONTAINER

BACKGROUND OF THE INVENTION

This invention relates to container for wine and more particularly to a container whose internal volume may be reduced to minimize the exposure of the contained wine to the atmosphere as the wine is removed in increments from the container.

A number of arrangements have been used or proposed to deal with the problem of deterioration in the quality of wine which occurs as a result of exposure to air after the original wine bottle has been opened and some of the wine removed. One commercially successful arrangement is to put the wine in a plastic bag 10 which is marketed in a box 12 as shown in FIG. 1. A valve or spigot 14 sealed to the bag is accessible from outside the box for withdrawing wine as desired. The bag 10 collapses from the force of atmospheric pressure as the wine is withdrawn, so the remaining wine is minimally exposed to the air. Since the entire container is discarded when empty, this arrangement is somewhat expensive and is only used for packages of comparatively large quantity such as three liters or more.

Another method for dealing with the oxidation problem involves the use of a pump 16 attached to the opening of a wine bottle 18 as shown in FIG. 2. This pump is employed for the purpose of removing as much air as possible from the volume inside the bottle where air has displaced some of the wine. While this may be somewhat effective, there is a limit to how much of a vacuum can be created by such a simple pump.

There have been many patents describing a container having a hollow central tube with external threads and means engaged with the threads for forcing a piston into the container to cause the contents to be disposed out of the tube. One such apparatus is described in U.S. Pat. No. 5,028,960 to Seager. Most such devices are concerned with forcing heavy, viscous fluids such as greases or creams out of the container and are not concerned with oxidation of the contents.

BRIEF SUMMARY OF THE INVENTION

Applicant has devised a convenient container for storing and preserving wine in the form of a telescoping container of very simple and straightforward construction. The inner cylindrical member includes threads on its outer surface and a comparatively small diameter axial tube terminating in a threaded neck which engages a cap. An O-ring seal adjacent the lower end of the inner member seals against the cylindrical inside surface of the outer member, which near its upper end, includes internally directed threads engaging the threads of the inner member. With the inner cylindrical member fully extended outwardly of the outer cylindrical member, a full regular (750 ml) bottle of wine may be poured into the container, the level of which will rise to near the top of the axial tube which, preferably, is transparent at the neck or, at least, translucent so that the level of the contained wine is visible below the cap. After wine is poured from the container, the inner cylindrical member is screwed down into the outer cylindrical member until it makes contact with the surface of the wine in the outer container, after which a slight further turning of the upper cylindrical member will force wine up the axial tube until the wine is again visible in the neck. In this manner the surface area of the wine in the container which is exposed to the air, (or oxygen) is limited to the area of the neck. Each time more wine is poured from the container, the inner cylindrical chamber is screwed further into the outer cylindrical chamber as described above, until some of the remaining wine is forced into the neck. After each such procedure, the level of the wine is visible at the neck down to where the container is almost empty.

BRIEF DESCRIPTION OF THE DRAWING(S)

This invention may be more clearly understood with the following detailed description and by reference to the drawings in which:

FIG. 1 is a perspective view, partly in phantom, of a prior art device for minimizing contact of wine with air as it is decanted from a container;

FIG. 2 is a side elevational view of another type of prior art device for limiting contact of wine in a bottle with air after some has been decanted;

FIG. 5 is an exploded view of the container of FIGS. 3 and 4;

FIG. 6 is an elevational view of the container of the invention with wine from a wine bottle being poured into it;

FIG. 7*a* is an elevational view of the container of the invention being used to pour wine in to a glass when the container is full; and FIG. 7*b* is an elevational view similar to FIG. 7*a* showing wine being poured from a container which is approximately half full.

DESCRIPTION OF THE PREFERRED EMBODIMENT

Figure 3:
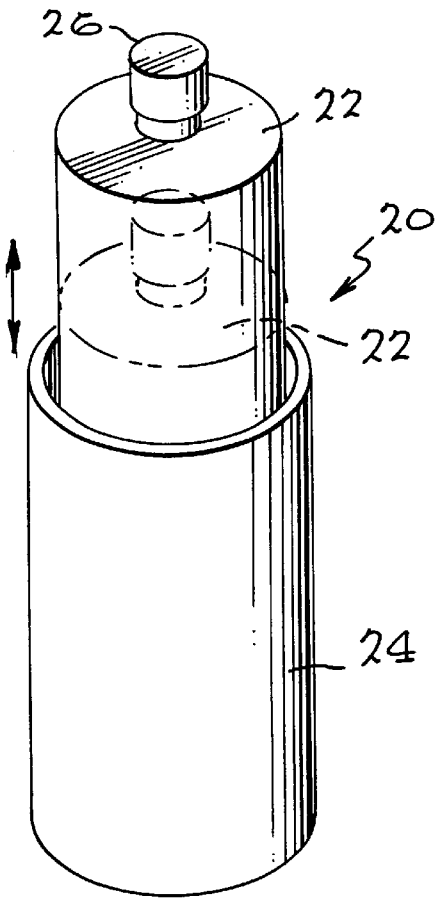
FIG. 3 is a perspective view of the container of the invention.

FIG. 3 is a perspective view of the container of the invention 20 including an inner cylindrical member 22, an outer cylindrical member 24 and a cap 26. As indicated by the arrow, the inner cylindrical member 22 telescopes in and out of outer cylindrical member 25, with container 20 shown in its closed position in dashed outline.

Figure 4:
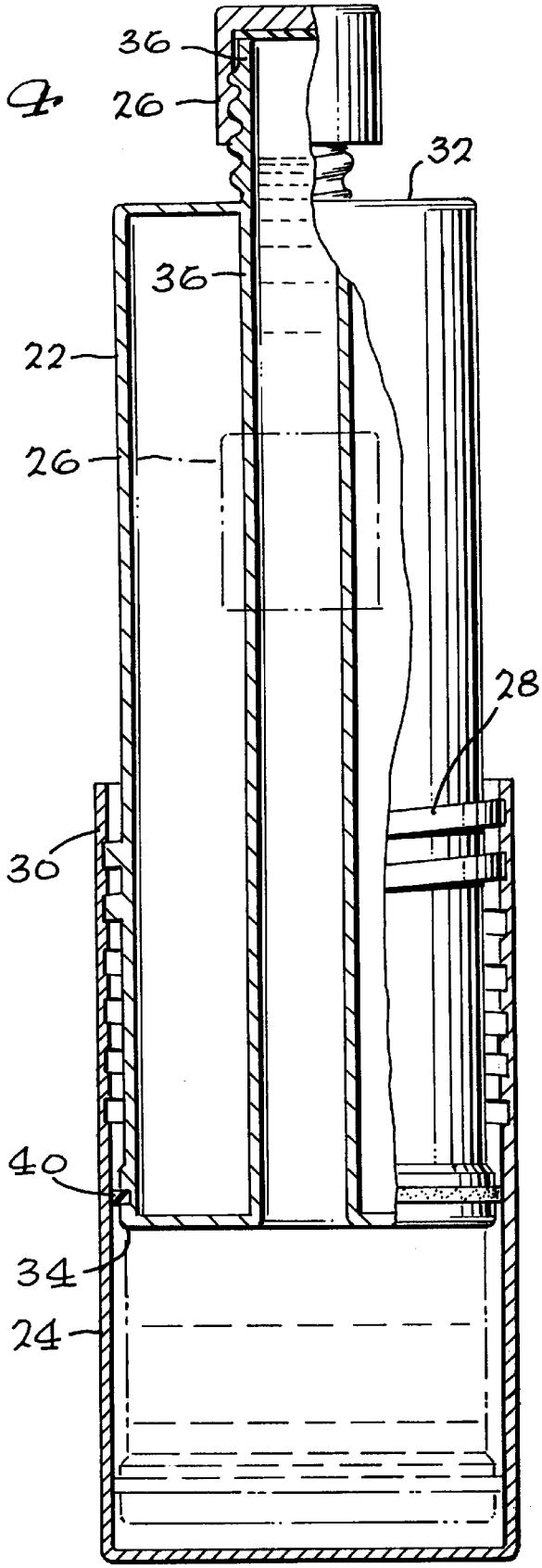
FIG. 4 is a sectional view of the container of FIG. 3.

FIG. 4 is a sectional view of the container 20 showing internal cylindrical member 22 with external threads 28 threadedly engaged with internal threads 30 formed on the inside surface of outer cylindrical member 24. Member 22 has a top end 32, a bottom end 34, and an axially directed tube 36 extending from its bottom end 34 through its top end 32 and terminating in a pouring neck 38, which is preferably transparent or translucent, shown threadedly engaged with cap 26. Near the lower end of member 22 is an O-ring seal 40 which seals against the inside surface of member 24. Seal 40 must be compatible with the liquid contents, in this case, wine, of container 20. As shown in dashed outline, the inner member 22 may reach any of several positions within outer member 24 before it reaches its lowest position. Each time wine is poured from container 20, member 22 is screwed a distance into member 24 until bottom end 34 makes contact with the surface of the wine. Further turning of member 22 causes the contained wine to be is forced up tube 36 to its neck 38. The combination of the engaged threads 28 and 30 and seal 40 assures proper alignment of member 22 and 24. It is preferred that the outer container 24 and the inner cylindrical container 22 be formed of stainless steel although some forms of plastic which do not absorb odors, etc. are acceptable.

FIG. 5 is an exploded view of the container 20 including cap 26, inner cylindrical member 22 and outer cylindrical member 24. Tube 36 is shown in dashed outline. Near its lower end, member 22 has a slightly increased diameter accommodating a groove into which is placed an O-ring seal 40. External threads 28 are also shown.

FIG. 6 is an elevational view of container 20 with the inner member 22 removed and with wine from a conventional wine bottle 42 being poured into outer member 24. Inner member 22 is then inserted into the top of member 24 and screwed into it until wine appears in neck 38 as described.

FIG. 7*a* shows a full container 20 decanting wine into a glass 44 and FIG. 7*b* shows a half full container 20 decanting wine into glass 44.

The above-described embodiments of the present invention are merely descriptive of its principles and are not to be considered limiting. While the specification is written describing a container for receiving the contents of a 750 ml. bottle, the invention is suitable for and can be made in any desired size. The scope of the present invention instead shall be determined from the scope of the following claims including their equivalents.

What is claimed is:

1. A container for storing and decanting a liquid comprising an outer member having a cylindrical inner wall;

a cylindrical inner member adapted to telescope within said outer member, said inner member including a bottom end, a top end and a tube extending through said top and bottom ends and terminating in a neck, a seal between said inner member and said outer wall; and means for telescoping said inner member into said outer member and forcing said a liquid through said tube into said neck.

2. A container as claimed in claim 1 wherein said seal means is impervious to wine.

3. A container as claimed in claim 1 wherein said means for telescoping said inner member into said outer member includes cooperating threads on said members.

4. A container as claimed in claim 1 wherein the internal diameter of said neck is substantially less than the diameter of said cylindrical inner wall.

5. A container as claimed in claim 1 wherein said means for telescoping said inner member into said outer member comprises a cylindrical inside wall of said outer member and internal threads in said inside wall and external threads on said cylindrical inner member engaged with said internal threads such that said cylindrical inner member may be manually screwed into said outer member to cause said bottom end to contact said contained liquid and force some of said contained liquid through said tube and into said neck.

6. A container for storing and decanting wine comprising an outer member having a cylindrical inside wall with internal threads in said wall and a bottom; and a cylindrical inner member in telescoping relation to said outer member having external threads engagable with said internal threads, a top end, a bottom end, an axially directed tube extending through said bottom and top ends, and an O-ring seal adjacent the bottom end of said cylindrical inner member sealing against said inside wall.

7. A container as claimed in claim 6 wherein said tube extends a significant distance past said top end to form a neck, external threads are formed on said neck and a cap is provided having internal threads engagable with said external threads of said neck.

8. A container as claimed in claim 7 wherein at least the neck portion of said tube is substantially transparent such that when said cylindrical inner member is telescoped into said outer member and said bottom end is in contact with said wine, further telescoping movement of said cylindrical inner member will force wine to flow up said tube until it becomes visible in said neck.

9. A container for storing and decanting wine comprising an outer member having a cylindrical inside wall with internal threads in said wall and a bottom;

a cylindrical inner member in telescoping relation to said outer member having external threads in threaded engagement with said internal threads, a top end, a bottom end, an axially directed tube extending through said bottom and top ends and terminating in a neck which is at least partly transparent, an increased diameter portion adjacent said bottom end and an O-ring seal positioned in said increased diameter portion and sealing against said inside wall.

10. A container as claimed in claim 9 further comprising a cap removably secured to said neck.

11. A telescoping wine bottle comprising telescoping inner and outer members having rigid walls, said inner member having an end surface movable into said outer member, said end surface being generally closed but including an axially directed tube opening into said end surface, and a seal between said members.

12. A telescoping wine bottle as claimed in claim 11, wherein said telescoping inner and outer members are cylindrical and are threadedly engaged such that, when said inner member is turned into said outer member, fluid within said outer member is forced through said axially directed tube.

13. A telescoping wine bottle as claimed in claim 11 wherein said inner member includes a bottle neck for decanting the contents of said bottle and said axially directed tube is connected to said bottle neck.

* * * * *